US005458670A

United States Patent [19]

Ogura et al.

[11] Patent Number: 5,458,670

[45] Date of Patent: Oct. 17, 1995

[54] IRON POWDER AND MIXED POWDER FOR POWDER METALLURGY AS WELL AS METHOD OF PRODUCING IRON POWDER

[75] Inventors: Kuniaki Ogura; Hiroyuki Ishikawa; Takeo Omura; Yoshiaki Maeda; Minoru Nitta; Hiroshi Ohtsubo; Yutaka Yoshii, all of Chiba, Japan

[73] Assignee: Kawasaki Steel Corporation, Japan

[21] Appl. No.: 232,121

[22] PCT Filed: Sep. 17, 1993

[86] PCT No.: PCT/JP93/01334

§ 371 Date: May 2, 1994

§ 102(e) Date: May 2, 1994

[87] PCT Pub. No.: WO94/06588

PCT Pub. Date: Mar. 31, 1994

[30] Foreign Application Priority Data

| | | | |
|---|---|---|---|
| Sep. 18, 1992 | [JP] | Japan | 4-250198 |
| Sep. 18, 1992 | [JP] | Japan | 4-250199 |
| May 21, 1993 | [JP] | Japan | 5-119628 |

[51] Int. Cl.[6] ..... B22F 1/00

[52] U.S. Cl. ..... 75/252; 75/246; 75/255

[58] Field of Search ..... 75/246, 255, 252

[56] References Cited

U.S. PATENT DOCUMENTS 4,518,427 5/1985 Tengzelius et al. ..... 75/255

FOREIGN PATENT DOCUMENTS 0311369 12/1989 European Pat. Off. .

*Primary Examiner*—Scott Kastler

*Attorney, Agent, or Firm*—Austin R. Miller

[57] ABSTRACT

This invention is to control the diffusion of C (carbon) from added graphite to particles of iron powder in the sintering to thereby improve the accuracy of dimensional change in the sintered body by using iron powder for powder metallurgy and a mixed powder thereof as a starting material in the production of sintered mechanical parts by adding the iron powder with Cu powder and graphite powder and companying and sintering them, in which 0.008–0.5 wt % in total of at least one element having a value of standard free energy of formation of oxide at 1000° C. of not more than −120 kcal/1 mol of $O_2$ is included in the iron powder and not less than 20% of the element is rendered into an oxide, or 0.01–0.20 wt % in total of an oxide powder of at least one element having a value of standard free energy of formation of oxide at 1000° C. of not more than −120 kcal/1 mol of $O_2$ is added to the mixed powder.

5 Claims, 1 Drawing Sheet

IRON POWDER AND MIXED POWDER FOR POWDER METALLURGY AS WELL AS METHOD OF PRODUCING IRON POWDER

TECHNICAL FIELD

Iron powder used for powder metallurgy is roughly divided into two types pure iron powder and alloying steel powder.

This invention relates to iron powder and mixed powder for powder metallurgy belonging to the above former pure iron powder as well as a method of producing such iron powder.

BACKGROUND ART

Iron powder for powder metallurgy is used in the production of a sintered part having usually a density of 5.0–7.2 g/cm$^3$. The part is made by adding and mixing iron powder with Cu powder, graphite powder and the like, shaping into a green compact in a mold, sintering and, if necessary, sizing a sintered body for dimensional correction.

However, the sintered body produced by adding Cu powder, graphite powder or the like to the iron powder is high in the strength, so that it has a drawback that the dimensional correction can not be conducted to a satisfactory extent due to spring-back of the sintered body even if the sizing for dimensional correction is conducted.

As a method of ensuring a desired dimensional accuracy without sizing, therefore, JP-B-56-12304 proposes a technique of enhancing the accuracy of dimensional change by improving particle size distribution of the starting powder, and JP-A-3-142342 proposes a technique of controlling a given size by predicting the dimensional change during sintering from the shape of powder.

However, the iron powder for powder metallurgy is added with Cu powder, graphite powder, lubricant and the like, or mixed for the uniformization of properties in the steps from powder formation to the shaping, or further transferred for replacement with a new vessel, so that the properties such as particle size distribution, shape and the like are apt to be changed at these steps. Also the position change of ingredients due to segregation of Cu powder or graphite powder added to the iron powder occurs and consequently the dimensional accuracy can not necessarily be obtained to a satisfactory extent.

DISCLOSURE OF INVENTION

The invention advantageously solves the above problems and provides iron powder and mixed powder for powder metallurgy capable of providing a dense sintered body with a high accuracy by enhancing the accuracy of dimensional change in the sintering (concretely green density: about 6.90 g/cm$^3$, scattering width of dimensional change: within 0.10%, preferably 0.06%) without impairing compressibility as well as a method of advantageously producing such iron powder.

The inventors have made various studies with respect to the composition of iron powder and the compounding ratio of additives in order to achieve the above object and found the following:

(1) The dimensional change in the sintered body is strongly correlated to the amount and particle size of graphite added to iron powder;

(2) Even when the amount and particle size of graphite changes, if an oxide of a particular element is existent on the surface of the iron powder at a constant quantity or more, the scattering width of dimensional change or the fluctuating width of dimensional change reduces; and (3) As the scattering width of the oxide quantity becomes small, the fluctuating width of dimensional change is small.

The invention is based on the above knowledges.

That is, the essential points and construction of the invention are as follows.

1. Iron powder for powder metallurgy consisting of 0.008–0.5 wt % in total of at least one element having a value of standard free energy of formation of oxide at 1000° C. of not more than −120 kcal/1 mol of $O_2$, not more than 0.30 wt % of oxygen and the reminder being Fe and inevitable impurities, in which not less than 20% of the above element forms an oxide.

2. Iron powder for powder metallurgy consisting of 0.008–0.5 wt % in total of at least one element having a value of standard free energy of formation of oxide at 1000° C. of not more than −120 kcal/1 mol of $O_2$, not more than 0.30 wt % of oxygen and the reminder being Fe and inevitable impurities, in which not less than 20% of the above element forms an oxide and a scattering width of oxidation ratio is not more than 50%.

3. Iron powder for powder metallurgy according to paragraph 1 or 2, wherein the element having a value of standard free energy of formation of oxide at 1000° C. of not more than −120 kcal/1 mol of $O_2$ is selected from Cr, Mn, V, Si, Ti and Al.

4. A mixed powder, characterized in that 0.01–0.20 wt % in total of oxide powder of at least one element having a value of standard free energy of formation of oxide at 1000° C. of not more than −120 kcal/1 mol of $O_2$ is added to a mixed powder formed by adding graphite powder or a mixture of graphite powder and Cu powder to iron powder.

5. A mixed powder according to paragraph 4, wherein the oxide powder of at least one element having a value of standard free energy of formation of oxide at 1000° C. of not more than −120 kcal/1 mol of $O_2$ is selected from $Cr_2O_3$, MnO, $SiO_2$, $V_2O_3$, $TiO_2$ and $Al_2O_3$.

6. A method of producing iron powder for powder metallurgy, characterized in that iron powder having a composition consisting of 0.008–0.5 wt % in total of at least one element having a value of standard free energy of formation of oxide at 1000° C. of not more than −120 kcal/1 mol of $O_2$, and the reminder being Fe and inevitable impurities is subjected to an oxidation treatment at a temperature of 100°–200° C. in a nitrogen atmosphere having an oxygen concentration of 2.5–15.0 vol % and then subjected to a selective reduction treatment for oxidized Fe in a reducing atmosphere at 800°–1000° C.

7. A method of producing iron powder for powder metallurgy according to paragraph 6, wherein the oxidation treatment of iron powder is conducted with stirring.

The invention will be described concretely based on experimental results originating in the invention.

The inventors have totally examined various experimental results and confirmed that the rate of dimensional change in the sintered body is strongly correlated to the amount and particle size of graphite added, and particularly, the scattering width of dimensional change (i.e. fluctuating width of dimensional change) tends to become large as the amount of graphite becomes large.

However, it is occasionally confirmed that the fluctuating width of dimensional change becomes small even though the amount of graphite added is large.

As a result of investigations on such a cause that the fluctuating width of dimensional change is small even if the amount of graphite added is large, it has been confirmed that this is due to the fact that a relatively large amount of oxide is existent on the surface of the iron powder.

However, when the oxide is existent on the surface of iron powder, the fluctuating width of dimensional change becomes not necessarily small.

Then, there has been considered a common point that each oxide could control the fluctuating width of dimensional change to a small extent. As a result, it has been elucidated that a good result is obtained when using all elements each having a value of standard free energy of formation of oxide at 1000° C. of not more than −120 kcal/1 mol of $O_2$.

In Table 1 are shown a value of standard free energy of formation of oxide at 1000° C. of each element, a composition of the resulting oxide, and a judgment on accuracy of dimensional change when each oxide is formed on the surface of the iron powder (oxide quantity: 0.1–0.2 wt %).

TABLE 1

| Element | Standard free energy of formation of oxide at 1000° C. (Kcal/l mol of $O_2$) | Oxide | Judgment |
|---|---|---|---|
| Cu | −37 | $Cu_2O$ | x |
| Ni | −57 | NiO | x |
| Cr | −126 | $Cr_2O_3$ | o |
| Mn | −140 | MnO | o |
| V | −148 | $V_2O_3$ | o |
| Si | −156 | $SiO_2$ | o |
| Ti | −165 | $TiO_2$ | o |
| Al | −203 | $Al_2O_3$ | o |

o . . . Fluctuating width of dimensional change: slight
x . . . Fluctuating width of dimensional change: large As seen from Table 1, good accuracy of dimensional change is obtained when an oxide is made from an element having a value of standard free energy of formation of oxide at 1000° C. of not more than −120 kcal/1 mol of $O_2$.

Although the reason why the accuracy of dimensional change is improved by existing the above oxide on the surface of iron powder is not yet clear, it is considered as follows.

When the aforementioned oxide exists on the surface of iron powder to a certain extent, the diffusion of C (carbon) from graphite added to particles of iron powder during the sintering is controlled and hence the amount of C invaded and diffused into the iron powder is held at an approximately constant value even if the amount and particle size of graphite added change, whereby a so-called Cu growth is stabilized to finally control the fluctuating width of dimensional change to a small range as compared with the fluctuating width of the amount of graphite added.

The above state is illustrated as shown in FIG. 1.

That is, when using the conventional iron powder has no oxide existing on its surface, as shown by a curved line ① in the above figure, the quantity of dimensional change largely varies with the change of C amount, while when an adequate quantity of oxide exists on the surface of the iron powder, as shown by a curved line ②, the inclination of the curved line becomes small, so that even if the C amount changes, the quantity of dimensional change is not so varied.

Even when the amount of graphite added varies as mentioned above, in order to effectively reduce the rate of dimensional change, it is necessary that 0.008–0.5 wt % of an element having a value of standard free energy of formation of oxide at 1000° C. of not more than −120 kcal/1 mol of $O_2$ (hereinafter referred to as adequate element simply) is included into the iron powder and not less than 20 wt % of the above element is rendered into an oxide.

When the amount of the adequate element is less than 0.008 wt %, the fluctuating width of dimensional change in the sintered body can not be reduced to the fluctuating width of graphite added, while when it exceeds 0.5 wt %, the compaction in the shaping rapidly lowers. Further, when the quantity of oxide is less than 20 wt %, as shown in FIG. 1, the inclination of a curve between amount of graphite and quantity of dimensional change is still large and hence the fluctuating width of dimensional change in the sintered body to the fluctuating width of graphite added can not be reduced.

As the adequate element, Cr, Mn, V, Si, Ti and Al are advantageously adaptable. Even the case of adding these elements alone or in admixture, when the amount is within a range of 0.008–0.5 wt % in total, the same effect can be obtained. Moreover, a preferable range of each element added alone is as follows:

Cr: 0.05–0.5 wt %, Mn: 0.01–0.3 wt %,

V: 0.008–0.5 wt %, Si: 0.008–0.5 wt %,

Ti: 0.008–0.5 wt %, Al: 0.008–0.5 wt %

Moreover, it is observed by EPMA that the oxide is dispersedly existent in the vicinity of the surface of the iron powder (about 10 μm from the surface) and in particles thereof. In the invention, it has been confirmed that a desired effect is obtained when the oxide-forming ratio is not less than 20 wt %, and the effect becomes large when the position of existing oxide is locally existent near the surface.

Furthermore, it is important to control the concentration of oxygen in iron powder to not more than 0.30 wt %. When oxygen is contained in an amount exceeding 0.30 wt%, the compressibility during the compact shaping lowers, which brings about degradation of strength in the product.

As mentioned above, when a given amount of the adequate element is included in the iron powder and not less than 20 wt % thereof is rendered into an oxide, the fluctuating width of dimensional change in the sintered body can largely be reduced as compared with the conventional case. As a result of the inventors' further studies, it is elucidated that it is effective to reduce the scattering width of oxidation ratio of the adequate element to not more than 50% (preferably not more than 30%) in order to further improve the accuracy of dimensional change in the sintered body.

That is, the quantity of dimensional change in the sintered body varies in accordance with the oxidation ratio of the adequate element as shown in FIG. 2. This tendency is conspicuous when the oxidation ratio is small. For example, in case of $SiO_2$, when the oxidation ratio is not more than 20%, the fluctuating width of dimensional change becomes fairly large. Therefore, when the scattering width of the oxidation ratio is large (particularly the oxidation ratio is small), the scattering width of dimensional change becomes large. Inversely, when the scattering width of the oxidation ratio is small, the fluctuating width of dimensional change is effectively mitigated.

In Table 2 are shown results measured on fluctuating width of dimensional change and green density in the sintered body when Si as an adequate element is included into iron powder at various amounts and the scattering width of oxidation ratio of Si are variously varied.

TABLE 2

| Symbol of iron powder | Si content (wt %) | Scattering range of oxidation ratio in Si content (%) | Scattering width of oxidation ratio in Si content (%) | Fluctuating width of dimensional change in sintered body (%) | Green density (g/cm$^3$) |
|---|---|---|---|---|---|
| A | 0.004 | 5~100 | 95 | 0.60 | 7.00 |
| B | 0.007 | 5~95 | 90 | 0.56 | 6.99 |
| C | 0.008 | 30~40 | 10 | 0.06 | 6.98 |
| D | 0.016 | 35~45 | 10 | 0.06 | 6.98 |
| E | 0.025 | 45~50 | 5 | 0.04 | 6.97 |
| F | 0.027 | 55~65 | 10 | 0.06 | 6.92 |
| G | 0.050 | 25~80 | 55 | 0.10 | 6.90 |
| H | 0.20 | 30~50 | 20 | 0.05 | 6.89 |
| I | 0.50 | 20~80 | 60 | 0.10 | 6.88 |
| J | 0.60 | 60~80 | 20 | 0.06 | 6.77 |

As seen from this table, when Si is included within a proper range and the oxidation ratio thereof is not less than 20 wt % and also the scattering width of the oxidation ratio is controlled to not more than 50%, there is obtained a very good accuracy of dimensional change that the fluctuating width of dimensional change in the sintered body is not more than 0.06%.

Moreover, all of the sintered bodies used in the above experiment are obtained by adding 2 wt % of Cu powder, 0.8 wt % of graphite powder and 1 wt % of zinc stearate as a lubricant to water-atomized iron powder reduced in a reducing atmosphere having a dew point of 10°–60° C., shaping into a green compact having a density of 6.9 g/cm$^3$ and then sintering in RX gas having a $CO_2$ content of 0.3% at 1130° C. for 20 minutes. The scattering of dimensional change is evaluated by a fluctuating width of dimensional change in the sintering based on the green compact having a given outer diameter with respect to 100 ring-shaped specimens having an outer diameter of 60 mm, an inner diameter of 25 mm and a height of 10 mm. Furthermore, the green density is measured when the same iron powder as mentioned above is added and mixed with 1 wt % of zinc stearate and shaped under a shaping pressure of 5 t/cm$^2$.

A preferable production method of the iron powder according to the invention will be described below.

At first, the production method of iron powder is not particularly restricted, so that the conventionally well-known methods such as water atomizing method, a reducing method and the like are adaptable. Among them, the water atomizing method is particularly advantageous in order to efficiently produce iron powder having a desired particle size, in which an average particle size of iron powder is preferably within a range of about 50–100 μm.

Then, it is necessary that at least 20 wt % of adequate element included is rendered into oxide by subjecting the iron powder to an oxidation treatment in a proper oxidizing atmosphere. For this purpose, it is important that the oxidation treatment is carried out at a temperature of 100°–200° C. in a nitrogen atmosphere having an oxygen concentration of 2.5–15.0 vol %.

When the concentration of oxygen in the atmosphere is less than 2.5 vol %, it is difficult to ensure an oxide content of not less than 20%, while when it exceeds 15.0 vol %, the oxygen content in the iron powder can not be controlled to not more than 0.30 wt % even by a reduction treatment as mentioned later and the compressibility lowers. The reason why the essential ingredient of the atmosphere is oxygen is due to the fact that it is easy to control the oxygen concentration in the atmosphere and also there is no risk of explosion as in hydrogen or the like and the economical merit is large as compared with the case of using inert gas such as Ar or the like.

Moreover, in order to control the scattering width of the oxidation ratio in the formation of the oxide by the above oxidation treatment to not more than 50%, it is enough to conduct the oxidation treatment under stirring of powder. As the stirring apparatus, a rotary kiln and an agitating dryer are advantageously adaptable.

Now, not less than 20% of the adequate element is rendered into an oxide by the aforementioned oxidation treatment, during which iron itself is oxidized to form an iron oxide. Since such an iron oxide undesirably deteriorates the compressibility, it is necessary to reduce the iron oxide.

In the method according to the invention, therefore, only the oxidized Fe is selectively reduced by subjecting to a reduction treatment in a reducing atmosphere at 800°–1000° C. after the above oxidation treatment. In the selective reduction treatment of the oxidized Fe, the reason why the treating temperature is limited to the range of 800°–1000° C. is due to the fact that when the treating temperature is lower than 800° C., it is difficult to reduce the oxygen content in the iron powder to not more than 0.30 wt %, while when it exceeds 1000° C., the oxide of the adequate element is also oxidized and it is difficult to ensure the adequate quantity of not less than 20 wt %. Moreover, the treating time is sufficient to be about 20–60 minutes.

Although the above explains the technique of enhancing the accuracy of dimensional change in the sintered body by modifying the iron powder itself, even when ordinary iron powder is used, the accuracy of dimensional change in the resulting sintered body can be improved by the application of the above technique.

That is, the aforementioned technique lies in that a given adequate element is included in the iron powder and a part thereof is rendered into an oxide. On the other hand, even if a given quantity of oxide powder of the adequate element is mixed with the ordinary iron powder as a starting powder for the sintered body, there is substantially no difference in view of the effect.

As the oxide powder of the adequate element, $Cr_2O_3$, MnO, $SiO_2$, $V_2O_3$, $TiO_2$, $Al_2O_3$ and the like are advantageously adaptable. The same effect as in case of modifying the iron powder itself can be obtained by adding at least one of these oxides at a quantity of 0.01–0.20 wt % in total.

The reason why the quantity of the oxide powder is limited to the range of 0.01–0.20 wt % is due to the fact that when the quantity is less than 0.01 wt %, the fluctuating width of dimensional change in the sintered body is still large, while when it exceeds 0.20 wt %, the green density and hence the strength of the sintered body rapidly lower.

In the case of such a mixed powder, there is caused a fear of deteriorating the accuracy due to segregation of the oxide powder based on nonuniform mixing. This is the same as in the scattering of oxidation ratio in the iron powder itself. Even if the segregation is somewhat caused, there is caused no segregation exceeding the upper limit of the oxidation ratio in the iron powder itself of 50%, so that there is substantially no problem.

On the contrary, the quantity of the oxide can strictly be controlled in the mixed powder, so that if uniform mixing is satisfied, the fluctuating width of dimensional change can be controlled with a higher accuracy and hence the quantity of dimensional change in the sintered body can freely be adjusted within a certain range.

In Table 3 are shown green density, dimensional change rate of the sintered body and transverse rupture strength of the sintered body when $Al_2O_3$ powder is added in various quantities as an oxide powder.

Moreover, the dimensional change in the longitudinal direction of the sintered body is measured before and after the sintering on 100 sintered bodies, each of which bodies is produced by adding and mixing water-atomized iron powder with 1.5 wt % of Cu powder, 0.9 wt % of graphite powder, 1 wt % of a solid lubricant (zinc stearate) and 0.01–0.25 wt % of fine alumina powder, shaping into a green compact having a length of 35 mm, a width of 10 mm and a height of 5 mm at a green density of 7.0 g/cm$^3$ and then sintering with a propane-modified gas at 1130° C. for 20 minutes.

Furthermore, the green density is measured when the same iron powder as mentioned above is added and mixed with 1 wt % of zinc stearate and shaped under a shaping pressure of 5 t/cm$^2$.

TABLE 3

| Addition amount of $Al_2O_3$ powder | Green density (g/cm$^3$) | Quantity of dimensional change in sintered body (%) | Fluctuating width of dimensional change (%) | Transverse rupture strength of sintered body (Kgf/mm$^2$) |
|---|---|---|---|---|
| 0 | 6.90 | 0.09 | 0.20 | 80 |
| 0.01 | 6.89 | 0.15 | 0.06 | 80 |
| 0.05 | 6.89 | 0.20 | 0.05 | 79 |
| 0.10 | 6.88 | 0.23 | 0.04 | 79 |
| 0.20 | 6.87 | 0.25 | 0.04 | 79 |
| 0.25 | 6.85 | 0.26 | 0.04 | 73 |

The quantity of dimensional change in the sintered body is based on the dimension of the green compact.

As seen from this table, the dimensional change tends to expand with the increase in the quantity of fine $Al_2O_3$ powder added. When the quantity is 0.1 wt %, the expansion of about 0.2% is caused as compared with the case of adding no fine powder, in which there is substantially no scattering of dimensional change.

Thus, when the quantity of $Al_2O_3$ powder added is within a range of 0.01–0.20 wt %, the quantity of dimensional change in the sintered body can exactly be changed by a given value in accordance with the quantity of $Al_2O_3$ powder added without decreasing the strength of the sintered body.

In such a mixed powder, therefore, when the quantity of the oxide powder added is properly adjusted, the dimension of the sintered body can optionally be adjusted. For instance, it is possible to produce plural kinds of the sintered bodies having different dimensions from a single shaping mold.

BEST MODE FOR CARRYING OUT THE INVENTION

EXAMPLE 1

Figure 1:
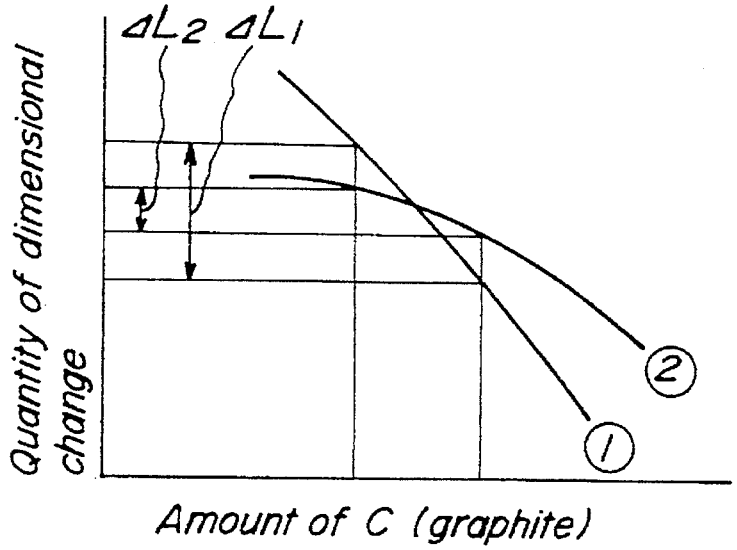
FIG. 1 is a graph showing a relation between amount of graphite added and quantity of dimensional change in sintered body.
Figure 2:
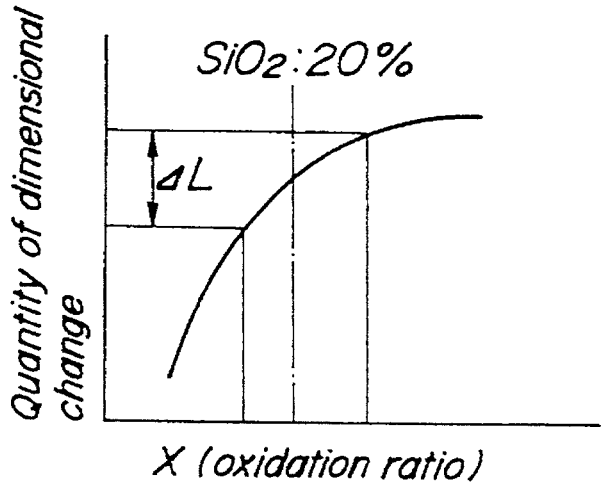
FIG. 2 is a graph showing a relation between oxidation ratio and quantity of dimensional change in sintered body.

Various iron powders having a composition as shown in Tables 4-1 to 4-3 (average particle size: 50–100 μm) were produced through a water atomization method and subjected to an oxidation treatment and further to a reduction treatment under conditions shown in Table 5.

The resulting iron powder was added and mixed with 2.0 wt % of Cu powder, 0.8 wt % of graphite powder and 1.0 wt % of zinc stearate as a lubricant, shaped into a green compact under a shaping pressure of 5.0 t/cm$^2$ and then sintered in a propane-modified gas at 1130° C. for 20 minutes.

The oxidation ratio of the added element after the reduction treatment, scattering width of oxidation ratio, green density and the fluctuating width of dimensional change and tensile strength of the resulting sintered body were measured to obtain results as shown in Tables 4-1 to 4-3.

Moreover, the fluctuating width of dimensional change was evaluated by a scattering width of dimensional change rate in the sintering on 100 ring-shaped specimens having an outer diameter of 60 mm, an inner diameter of 25 mm and a height of 10 mm based on the green compact having the same outer diameter. On the other hand, the green density was measured when the same iron powder as mentioned above was added and mixed with 1 wt % of zinc stearate and shaped under a shaping pressure of 5 t/cm$^2$.

TABLE 4-1

| Run No. | Composition of iron powder (%) Cr | O | Oxidation ratio in Cr content (%) | Scattering width of oxidation ratio in Cr content (%) | Oxidized Cr near to surface total oxidized Cr | Fluctuating width of dimensional change (%) | Green density (g/cm$^3$) | Tensile strength (kg/mm$^2$) | Remarks |
|---|---|---|---|---|---|---|---|---|---|
| 1 | 0.08 | 0.10 | 68(40~95) | 55 | 54 | 0.10 | 6.91 | 38 | Acceptable Example 1 |
| 2 | 0.15 | 0.15 | 43(20~75) | 55 | 54 | 0.08 | 6.93 | 40 | Acceptable Example 2 |
| 3 | 0.35 | 0.15 | 50(20~80) | 60 | 75 | 0.06 | 6.89 | 40 | Acceptable Example 3 |
| 4 | 0.26 | 0.10 | 25(15~35) | 20 | 45 | 0.04 | 6.91 | 39 | Acceptable Example 4 |
| 5 | 0.20 | 0.10 | 50(38~62) | 24 | 24 | 0.03 | 6.90 | 39 | Acceptable Example 5 |
| 6 | 0.21 | 0.10 | 15(0~30) | 30 | 55 | 0.19 | 6.91 | 42 | Comparative Example 1 |
| 7 | 0.005 | 0.11 | 45(15~75) | 60 | 55 | 0.21 | 6.93 | 36 | Comparative Example 2 |
| 8 | 0.66 | 0.20 | 66(36~96) | 60 | 44 | 0.11 | 6.75 | 35 | Comparative Example 3 |

| Run No. | Composition of iron powder (%) Si | O | Oxidation ratio in Si content (%) | Scattering width of oxidation ratio in Si content (%) | Oxidized Si near to surface total oxidized Si | Fluctuating width of dimensional change (%) | Green density (g/cm$^3$) | Tensile strength (kg/mm$^2$) | Remarks |
|---|---|---|---|---|---|---|---|---|---|
| 9 | 0.008 | 0.10 | 44(16~72) | 56 | 49 | 0.09 | 6.91 | 42 | Acceptable Example 6 |
| 10 | 0.10 | 0.12 | 50(21~79) | 58 | 77 | 0.06 | 6.92 | 40 | Acceptable Example 7 |
| 11 | 0.40 | 0.25 | 62(30~94) | 64 | 48 | 0.08 | 6.89 | 38 | Acceptable Example 8 |
| 12 | 0.08 | 0.13 | 52(40~64) | 24 | 55 | 0.03 | 6.89 | 40 | Acceptable Example 9 |

TABLE 4-1-continued

| | | | | | | | | | |
|---|---|---|---|---|---|---|---|---|---|
| 13 | 0.08 | 0.13 | 24(20~28) | 8 | 60 | 0.03 | 6.91 | 39 | Acceptable Example 10 |
| 14 | 0.11 | 0.14 | 15(0~30) | 30 | 50 | 0.20 | 6.90 | 42 | Comparative Example 4 |
| 15 | 0.005 | 0.10 | 40(13~67) | 54 | 53 | 0.18 | 6.91 | 36 | Comparative Example 5 |
| 16 | 0.60 | 0.40 | 62(36~88) | 52 | 47 | 0.11 | 6.72 | 33 | Comparative Example 6 |

TABLE 4-2

| Run | Composition of iron powder (%) | | Oxidation ratio in Mn content | Scattering width of oxidation ratio in Mn content | Oxidized Mn near to surface total | Fluctuating width of dimensional change | Green density | Tensile strength | |
|---|---|---|---|---|---|---|---|---|---|
| No. | M | O | (%) | (%) | oxidized Mn | (%) | (g/cm$^3$) | (kg/mm$^2$) | Remarks |
| 17 | 0.03 | 0.10 | 45(18~72) | 54 | 76 | 0.06 | 6.93 | 39 | Acceptable Example 11 |
| 18 | 0.15 | 0.15 | 47(20~74) | 54 | 50 | 0.09 | 6.93 | 40 | Acceptable Example 12 |
| 19 | 0.25 | 0.15 | 57(28~86) | 58 | 49 | 0.07 | 6.90 | 39 | Acceptable Example 13 |
| 20 | 0.18 | 0.14 | 50(41~59) | 18 | 70 | 0.04 | 6.89 | 40 | Acceptable Example 14 |
| 21 | 0.20 | 0.13 | 35(18~52) | 34 | 45 | 0.04 | 6.89 | 41 | Acceptable Example 15 |
| 22 | 0.21 | 0.13 | 13(0~26) | 26 | 54 | 0.19 | 6.92 | 42 | Comparative Example 7 |
| 23 | 0.005 | 0.11 | 47(17~77) | 60 | 55 | 0.21 | 6.93 | 36 | Comparative Example 8 |
| 24 | 0.60 | 0.17 | 60(30~90) | 60 | 40 | 0.11 | 6.76 | 35 | Comparative Example 9 |

| Run | Composition of iron powder (%) | | Oxidation ratio in Al content | Scattering width of oxidation ratio in Al content | Oxidized Al near to surface total | Fluctuating width of dimensional change | Green density | Tensile strength | |
|---|---|---|---|---|---|---|---|---|---|
| No. | Al | O | (%) | (%) | oxidized Al | (%) | (g/cm$^3$) | (kg/mm$^2$) | Remarks |
| 25 | 0.008 | 0.10 | 41(15~66) | 51 | 50 | 0.09 | 6.92 | 39 | Acceptable Example 16 |
| 26 | 0.03 | 0.11 | 47(21~73) | 52 | 68 | 0.08 | 6.90 | 39 | Acceptable Example 17 |
| 27 | 0.41 | 0.24 | 55(20~90) | 70 | 42 | 0.06 | 6.90 | 40 | Acceptable Example 18 |
| 28 | 0.06 | 0.13 | 43(32~54) | 22 | 60 | 0.03 | 6.90 | 39 | Acceptable Example 19 |
| 29 | 0.05 | 0.11 | 26(20~32) | 12 | 58 | 0.03 | 6.90 | 39 | Acceptable Example 20 |
| 30 | 0.21 | 0.14 | 16(0~32) | 32 | 51 | 0.20 | 6.92 | 42 | Comparative Example 10 |
| 31 | 0.003 | 0.10 | 32(5~59) | 54 | 40 | 0.20 | 6.90 | 38 | Comparative Example 11 |
| 32 | 0.60 | 0.39 | 64(28~100) | 72 | 49 | 0.11 | 6.70 | 31 | Comparative Example 12 |

TABLE 4-3

| Run | Composition of iron powder (%) | | Oxidation ratio in Ti content | Scattering width of oxidation ratio in Ti content | Oxidized Ti near to surface total | Fluctuating width of dimensional change | Green density | Tensile strength | |
|---|---|---|---|---|---|---|---|---|---|
| No. | Ti | O | (%) | (%) | oxidized Ti | (%) | (g/cm$^3$) | (kg/mm$^2$) | Remarks |
| 33 | 0.008 | 0.10 | 57(27~87) | 60 | 49 | 0.09 | 6.90 | 40 | Acceptable Example 21 |
| 34 | 0.08 | 0.11 | 58(32~84) | 52 | 70 | 0.06 | 6.91 | 40 | Acceptable Example 22 |
| 35 | 0.40 | 0.14 | 38(10~66) | 56 | 45 | 0.08 | 6.91 | 41 | Acceptable Example 23 |
| 36 | 0.10 | 0.13 | 24(20~28) | 8 | 55 | 0.04 | 6.91 | 40 | Acceptable Example 24 |
| 37 | 0.10 | 0.13 | 54(44~64) | 20 | 69 | 0.03 | 6.91 | 39 | Acceptable Example 25 |
| 38 | 0.10 | 0.13 | 15(0~30) | 30 | 49 | 0.19 | 6.92 | 43 | Comparative Example 13 |
| 39 | 0.003 | 0.10 | 35(5~65) | 60 | 35 | 0.19 | 6.93 | 39 | Comparative Example 14 |
| 40 | 0.59 | 0.30 | 60(29~91) | 62 | 35 | 0.10 | 6.72 | 32 | Comparative Example 15 |

| Run | Composition of iron powder (%) | | Oxidation ratio in V content | Scattering width of oxidation ratio in V content | Oxidized V near to surface total | Fluctuating width of dimensional change | Green density | Tensile strength | |
|---|---|---|---|---|---|---|---|---|---|
| No. | V | O | (%) | (%) | oxidized V | (%) | (g/cm$^3$) | (kg/mm$^2$) | Remarks |
| 41 | 0.008 | 0.10 | 37(10~64) | 54 | 40 | 0.10 | 6.90 | 39 | Acceptable Example 26 |
| 42 | 0.07 | 0.11 | 60(30~90) | 60 | 74 | 0.06 | 6.91 | 39 | Acceptable Example 27 |
| 43 | 0.39 | 0.15 | 57(31~82) | 51 | 45 | 0.08 | 6.90 | 40 | Acceptable Example 28 |
| 44 | 0.11 | 0.13 | 75(54~96 | 42 | 62 | 0.04 | 6.93 | 39 | Acceptable Example 29 |
| 45 | 0.08 | 0.12 | 27(20~34) | 14 | 70 | 0.04 | 6.92 | 39 | Acceptable Example 30 |
| 46 | 0.09 | 0.12 | 10(0~20) | 20 | 63 | 0.19 | 6.92 | 42 | Comparative Example 16 |
| 47 | 0.003 | 0.10 | 32(5~59) | 54 | 45 | 0.21 | 6.91 | 38 | Comparative Example 17 |
| 48 | 0.55 | 0.20 | 71(43~99) | 56 | 50 | 0.11 | 6.76 | 31 | Comparative Example 18 |

TABLE 5

| Treating conditions | Oxygen concentration (vol %) | Oxidation temperature (°C.) | Reduction temperature (°C.) | Reducing atmosphere | Stirring |
|---|---|---|---|---|---|
| Acceptable Example 1 | 3 | 150 | 950 | $H_2$(Dry) | none |
| Acceptable Example 2 | 5 | 150 | 970 | $H_2$(Dry) | none |
| Acceptable Example 3 | 2.8 | 150 | 850 | $H_2$(Dry) | none |
| Acceptable Example 4 | 10 | 150 | 880 | $H_2$(Dry) | conducted |
| Acceptable Example 5 | 7 | 150 | 1000 | $H_2$(Dry) | conducted |
| Acceptable Example 6 | 12 | 150 | 950 | $H_2$(due point = 30° C.) | none |
| Acceptable Example 7 | 5 | 150 | 830 | $H_2$(due point = 30° C.) | none |
| Acceptable Example 8 | 5 | 130 | 920 | $H_2$(Dry) | none |
| Acceptable Example 9 | 3 | 170 | 950 | $H_2$(due point = 30° C.) | conducted |
| Acceptable Example 10 | 3 | 170 | 950 | $H_2$(Dry) | conducted |
| Acceptable Example 11~13 | 3 | 150 | 950 | $H_2$(Dry) | none |
| Acceptable Example 14~15 | 3 | 150 | 950 | $H_2$(Dry) | conducted |
| Acceptable Example 16~18 | 5 | 170 | 900 | $H_2$(Dry) | none |
| Acceptable Example 19~20 | 5 | 170 | 900 | $H_2$(Dry) | conducted |
| Acceptable Example 21~23 | 3 | 170 | 970 | $H_2$(Dry) | none |
| Acceptable Example 24~25 | 3 | 170 | 970 | $H_2$(Dry) | conducted |
| Acceptable Example 26~28 | 5 | 170 | 970 | $H_2$(Dry) | none |
| Acceptable Example 29~30 | 5 | 170 | 970 | $H_2$(Dry) | conducted |
| Comparative Example 1, 4, 7 | 1 | 170 | 950 | $H_2$(Dry) | conducted |
| Comparative Example 10, 13, 16 | 3 | 150 | 1050 | $H_2$(Dry) | conducted |
| other comparative examples | 3 | 150 | 950 | $H_2$(Dry) | none |

As shown in Table 4, all of iron powders containing a given range of an adequate element and subjected to the oxidation treatment and the reduction treatment according to the invention contain not less than 20% of oxide of the added adequate element. When the sintered body is produced by using such an iron powder, the fluctuating width of dimensional change in the sintered body is not more than 0.1%, which is considerably excellent as compared with the conventional one. Furthermore, the green density and tensile strength are as high as about 6.9 kg/mm$^3$ and about 40 kg/mm$^2$, respectively. When the stirring is particularly conducted in the oxidation treatment (Acceptable Examples 4–5, 9–10, 14–15, 19–20, 24–25, 29–30), the scattering width of oxidation ratio of the added adequate element is suppressed to not more than 50% and hence the fluctuating width of dimensional change is not more than 0.05%, whereby a more excellent accuracy of dimensional change is obtained.

On the contrary, in Comparative Examples 1, 4 and 7, the oxygen concentration in the atmosphere for the oxidation treatment is 1%, so that the oxidation ratio of the added adequate element is less than 10%, while in Comparative Examples 10, 13 and 16, the temperature in the reduction treatment exceeds 1000° C., so that the oxidation ratio of the added adequate element is less than 20%. In these Comparative Examples, a good accuracy of dimensional change is not obtained. In Comparative Examples 2, 5, 8, 11, 14 and 17 in which the amount of the adequate element added is less than the lower limit, even if the production conditions are adequate, the fluctuating width of dimensional change is as large as about 0.20%, while in Comparative Examples 3, 6, 9, 12, 15 and 18 in which the amount of the adequate element added is excessive, rapid decrease of compressibility and hence the decrease of strength in the sintered body was observed.

Moreover, when the oxygen concentration in the atmosphere for the oxidation treatment exceeded 15%, or when the temperature of the oxidation treatment exceeded 200° C., the oxygen content after the treatment became too large and a long time was taken in the reduction treatment. Further, when the temperature in the reduction treatment was lower than 800° C., a long reducing time was undesirably taken.

EXAMPLE 2

Iron powders having a composition as shown in Table 6 (average particle size: 50–100 μm) was produced through water atomization method and then subjected to an oxidation treatment and reduction treatment under conditions shown in Table 7.

Then, green compacts and sintered bodies were produced in the same manner as in Example 1.

The oxidation ratio of the added adequate element after the reduction treatment, scattering width of oxidation ratio, green density and the fluctuating width of dimensional change and tensile strength of the resulting sintered body were measured to obtain results as shown in Table 6.

TABLE 6

| Run | Composition of iron powder (%) | | | | | | Oxidation ratio of elements added | Scattering width of oxidation ratio of elements added | Fluctuating width of dimensional change | Green density | Tensile strength (kg/ | |
|---|---|---|---|---|---|---|---|---|---|---|---|---|
| No. | Cr | Si | Mn | Al | Ti | V | (%) | (%) | (%) | (g/cm$^3$) | mm$^2$) | Remarks |
| 49 | 0.10 | — | — | 0.02 | — | — | 43(20~75) | 55 | 0.10 | 6.92 | 40 | Acceptable Example 31 |
| 50 | — | 0.07 | — | — | — | 0.03 | 25(15~35) | 20 | 0.03 | 6.93 | 40 | Acceptable Example 32 |
| 51 | — | — | 0.20 | — | 0.05 | — | 50(38~62) | 24 | 0.03 | 6.90 | 40 | Acceptable Example 33 |
| 52 | 0.08 | 0.08 | 0.20 | — | — | — | 55(28~82) | 54 | 0.09 | 6.91 | 39 | Acceptable Example 34 |
| 53 | — | 0.08 | 0.15 | 0.03 | — | — | 52(26~78) | 52 | 0.06 | 6.91 | 39 | Acceptable Example 35 |
| 54 | — | — | 0.10 | — | 0.10 | 0.06 | 70(40~100) | 60 | 0.08 | 6.90 | 39 | Acceptable Example 36 |
| 55 | 0.05 | 0.07 | 0.20 | 0.04 | — | — | 28(38~62) | 24 | 0.03 | 6.89 | 38 | Acceptable Example 37 |
| 56 | 0.06 | 0.10 | 0.15 | — | 0.05 | 0.05 | 68(40~95) | 55 | 0.08 | 6.89 | 39 | Acceptable Example 38 |
| 57 | 0.05 | 0.08 | 0.16 | 0.05 | 0.04 | 0.05 | 72(58~86) | 28 | 0.03 | 6.89 | 38 | Acceptable Example 39 |

TABLE 7

| Treating conditions | Oxygen concentration (vol %) | Oxidation temperature (°C.) | Reduction temperature (°C.) | Reducing atmosphere | Stirring |
|---|---|---|---|---|---|
| Acceptable Example 31 | 4 | 150 | 950 | $H_2$(Dry) | none |
| Acceptable Example 32 | 3 | 150 | 970 | $H_2$(Dry) | conducted |
| Acceptable Example 33 | 3 | 150 | 850 | $H_2$(Dry) | conducted |
| Acceptable Example 34 | 8 | 150 | 880 | $H_2$(Dry) | none |
| Acceptable Example 35 | 5 | 150 | 1000 | $H_2$(Dry) | none |
| Acceptable Example 36 | 5 | 150 | 950 | $H_2$(due point = 30° C.) | none |
| Acceptable Example 37 | 5 | 150 | 830 | $H_2$(due point = 30° C.) | conducted |
| Acceptable Example 38 | 5 | 130 | 920 | $H_2$(Dry) | none |
| Acceptable Example 39 | 5 | 170 | 950 | $H_2$(due point = 30° C.) | conducted |

As shown in Table 6, even when a mixture of various adequate elements was added, if the amount of the mixture added was proper and the oxidation and reduction treatments were conducted according to the invention, not less than 20% of each added adequate element in the resulting iron powder was rendered into an oxide. When such iron powder was used to form a sintered body, the fluctuating width of dimensional change in the sintered body was as small as not more than 0.1%, and the green density and tensile strength were as high as about 6.9 kg/mm$^3$ and about 40 kg/mm$^2$, respectively.

Particularly, when stirring was conducted in the oxidation treatment (Acceptable Examples 32–33, 37, 39), the scattering width of oxidation ratio of the added adequate element was suppressed to not more than 50% and hence the fluctuating width of dimensional change was 0.03% and a very excellent accuracy of dimensional change was obtained.

EXAMPLE 3

Iron powder (purity: 99.9%, particle size: 80 μm) was added with a given quantity of an oxide shown in Table 8 and added and mixed with 2.0 wt % of Cu powder, 0.8 wt % of graphite powder and 1.0 wt % of zinc stearate as a lubricant, shaped into a green compact under a shaping pressure of 5 t/cm$^2$ and then sintered with a propane-modified gas at 1130° C. for 20 minutes.

The fluctuating width of dimensional change and tensile strength of the resulting sintered body and the green density of the green compact were measured to obtain results as shown in Table 8.

Moreover, the fluctuating width of dimensional change was evaluated by a scattering width of dimensional change in the sintering on 100 ring-shaped specimens having an outer diameter of 60 mm, an inner diameter of 25 mm and a height of 10 mm based on the green compact having the same outer diameter. And also, the green density was measured when the same iron powder as mentioned above was added and mixed with 1 wt % of zinc stearate and shaped under a shaping pressure of 5 t/cm$^2$.

TABLE 8

| No. | Addition amount of oxide (%) | | Fluctuating width of dimensional change (%) | Green density (g/cm$^3$) | Tensile strength (kg/mm$^2$) | Remarks |
|---|---|---|---|---|---|---|
| 1 | $Cr_2O_3$ | 0.02 | 0.05 | 6.91 | 40 | Acceptable Example 1 |
| 2 | " | 0.18 | 0.03 | 6.90 | 40 | Acceptable Example 2 |
| 3 | " | 0.005 | 0.19 | 6.92 | 42 | Comparative Example 1 |
| 4 | " | 0.30 | 0.11 | 6.77 | 34 | Comparative Example 2 |
| 5 | $SiO_2$ | 0.02 | 0.04 | 6.90 | 40 | Acceptable Example 3 |
| 6 | " | 0.18 | 0.04 | 6.89 | 39 | Acceptable Example 4 |
| 7 | " | 0.005 | 0.19 | 6.90 | 42 | Comparative Example 3 |
| 8 | " | 0.30 | 0.11 | 6.75 | 29 | Comparative Example 4 |
| 9 | MnO | 0.02 | 0.05 | 6.92 | 41 | Acceptable Example 5 |
| 10 | " | 0.18 | 0.04 | 6.90 | 40 | Acceptable Example 6 |
| 11 | " | 0.005 | 0.19 | 6.92 | 42 | Comparative Example 5 |
| 12 | " | 0.30 | 0.10 | 6.77 | 34 | Comparative Example 6 |
| 13 | $Al_2O_3$ | 0.02 | 0.04 | 6.91 | 40 | Acceptable Example 7 |
| 14 | " | 0.18 | 0.02 | 6.89 | 39 | Acceptable Example 8 |
| 15 | " | 0.005 | 0.18 | 6.91 | 41 | Comparative Example 7 |
| 16 | " | 0.30 | 0.10 | 6.78 | 30 | Comparative Example 8 |
| 17 | $TiO_2$ | 0.02 | 0.05 | 6.91 | 41 | Acceptable Example 9 |
| 18 | " | 0.18 | 0.03 | 6.90 | 39 | Acceptable Example 10 |
| 19 | " | 0.005 | 0.19 | 6.91 | 42 | Comparative Example 9 |
| 20 | " | 0.30 | 0.10 | 6.78 | 35 | Comparative Example 10 |
| 21 | $V_2O_3$ | 0.02 | 0.04 | 6.91 | 41 | Acceptable Example 11 |
| 22 | " | 0.18 | 0.03 | 6.90 | 40 | Acceptable Example 12 |
| 23 | " | 0.005 | 0.19 | 6.90 | 42 | Comparative Example 11 |
| 24 | " | 0.30 | 0.10 | 6.78 | 33 | Comparative Example 12 |
| 25 | $Cu_2O$ | 0.1 | 0.18 | 6.90 | 42 | Comparative Example 13 |
| 26 | NiO | 0.1 | 0.20 | 6.91 | 41 | Comparative Example 14 |

As shown in Table 8, when the sintered body was produced by using the mixed powder according to the invention in which the adequate elements were added at a given amount, the fluctuating width of dimensional change in the sintered body was not more than 0.05% and was considerably lower as compared with the conventional one, and also the green density and tensile strength were as high as about 6.9 kg/mm$^3$ and about 40 kg/mm$^2$, respectively.

On the contrary, when the quantity of the oxide powder added exceeded the range defined in the invention, rapid decrease of compressibility and hence decrease of strength in the sintered body were observed as in Comparative Examples 2, 4, 6, 8, 10 and 12. Further, when the the quantity of the oxide powder added was less than the adequate quantity, the fluctuating width of dimensional change was as large as about 0.2% as in Comparative Examples 1, 3, 5, 7, 9 and 11.

In Comparative Examples 13 and 14 using $Cu_2O$ or NiO powder having a value of standard free energy of formation of oxide at 1000° C. of not less than −120 kcal/1 mol of $O_2$, the fluctuating width of dimensional change was not small.

EXAMPLE 4

Table 9 shows a chemical composition of iron powder used. The iron powder was obtained by water-atomizing molten steel to form a green powder, subjecting the green powder to an oxidation treatment in a nitrogen atmosphere containing 3 vol % of oxygen at 140° C. for 60 minutes, reducing in a hydrogen containing atmosphere at 750°–1050° C. for 20 minutes and then pulverizing and sieving it.

In the analysis of Cr, Mn as an oxide, these elements are extracted as an inclusion through the alcoholic iodine method and calculated in the form of $Cr_2O_3$ and MnO.

The fluctuating width of dimensional change and tensile strength when the sintered body was produced by using the above iron powder, the oxidation ratio of the added adequate element after the reduction treatment and the green density of the green compact were measured to obtain results as shown in Table 10.

As to the dimensional change of the sintered body, the influence of graphite quantity was examined by a difference between Fe-2.0% Cu-0.8% graphite (hereinafter abbreviated as Gr) and Fe-2.0% Cu-1.0% Gr obtained by mixing graphite powder and copper powder with iron powder. The difference between both was measured with respect to 20 specimens. Each specimen had a ring shape having an outer diameter of 60 mm, an inner diameter of 25 mm and a height of 10 mm and was obtained by shaping into a green compact having a green density of 6.85 g/cm$^3$ and then sintering in a nitrogen atmosphere at 1130° C. for 20 minutes.

Furthermore, the compressibility was evaluated by a green density when the iron powder was added with 1 wt % of zinc stearate (Fe-1.0% ZnSt) and shaped into a tablet of 11 mmϕ×10 mm under a shaping pressure of 5 t/cm$^2$.

Moreover, the strength was evaluated by a tensile strength when the iron powder was mixed with graphite powder and copper powder so as to have a composition of Fe-2.0% Cu-0.8% Gr, shaped into a JSPM standard tensile testing specimen (green density: 6.85 g/cm$^3$) and sintered in a nitrogen atmosphere at 1130° C. for 20 minutes.

TABLE 9

| No. | Reduction temperature (°C.) | Reducing atmosphere | Composition of iron powder (%) Mn | Cr | O | Remarks |
|---|---|---|---|---|---|---|
| 1 | 950 | $H_2$(Dry) | 0.15 | 0.10 | 0.22 | Acceptable Example 1 |
| 2 | 970 | $H_2$(Dry) | 0.18 | 0.15 | 0.20 | Acceptable Example 2 |
| 3 | 850 | $H_2$(Dry) | 0.20 | 0.26 | 0.19 | Acceptable Example 3 |
| 4 | 880 | $H_2$(Dry) | 0.10 | 0.18 | 0.26 | Acceptable Example 4 |
| 5 | 1000 | $H_2$(Dry) | 0.10 | 0.40 | 0.15 | Acceptable Example 5 |
| 6 | 950 | $H_2$(dew point = 30° C.) | 0.14 | 0.35 | 0.21 | Acceptable Example 6 |
| 7 | 830 | $H_2$(dew point = 30° C.) | 0.14 | 0.20 | 0.20 | Acceptable Example 7 |
| 8 | 920 | $H_2$(dew point = 45° C.) | 0.13 | 0.21 | 0.28 | Acceptable Example 8 |
| 9 | 950 | $H_2$(dew point = 45° C.) | 0.10 | 0.15 | 0.18 | Acceptable Example 9 |
| 10 | 1050 | $H_2$(Dry) | 0.19 | 0.21 | 0.11 | Comparative Example 1 |
| 11 | 1040 | $H_2$(Dry) | 0.16 | 0.11 | 0.10 | Comparative Example 2 |
| 12 | 970 | $H_2$(Dry) | 0.003 | 0.003 | 0.12 | Comparative Example 3 |
| 13 | 970 | $H_2$(Dry) | 0.17 | 0.60 | 0.24 | Comparative Example 4 |
| 14 | 970 | $H_2$(Dry) | 0.40 | 0.20 | 0.19 | Comparative Example 5 |
| 15 | 750 | $H_2$(dew point = 30° C.) | 0.16 | 0.15 | 0.40 | Comparative Example 6 |

TABLE 10

| No. | Oxidation ratio of Cr and Mn (%) | Oxidized Cr, Mn near to surface / Total oxidized Cr, Mn (%) | Fluctuating width of dimensional change (%) | Green density (g/cm$^3$) | Tensile strength (kgf/mm$^2$) | Remarks |
|---|---|---|---|---|---|---|
| 1 | 50 | 54 | 0.10 | 6.91 | 38 | Acceptable Example 1 |
| 2 | 45 | 54 | 0.11 | 6.93 | 40 | Acceptable Example 2 |
| 3 | 32 | 45 | 0.11 | 6.91 | 39 | Acceptable Example 3 |
| 4 | 71 | 57 | 0.12 | 6.89 | 40 | Acceptable Example 4 |
| 5 | 25 | 70 | 0.10 | 6.89 | 45 | Acceptable Example 5 |
| 6 | 43 | 75 | 0.08 | 6.90 | 44 | Acceptable Example 6 |
| 7 | 37 | 74 | 0.06 | 6.89 | 40 | Acceptable Example 7 |
| 8 | 39 | 71 | 0.05 | 6.90 | 42 | Acceptable Example 8 |
| 9 | 51 | 88 | 0.07 | 6.91 | 42 | Acceptable Example 9 |
| 10 | 15 | 55 | 0.18 | 6.91 | 42 | Comparative Example 1 |
| 11 | 18 | 54 | 0.19 | 6.91 | 40 | Comparative Example 2 |
| 12 | 21 | 45 | 0.21 | 6.93 | 36 | Comparative Example 3 |
| 13 | 76 | 44 | 0.11 | 6.75 | 37 | Comparative Example 4 |
| 14 | 60 | 56 | 0.11 | 6.76 | 31 | Comparative Example 5 |
| 15 | 79 | 57 | 0.10 | 6.72 | 34 | Comparative Example 6 |

As seen from Table 10, all of iron powders satisfying the requirements according to the invention exhibited an accuracy of dimension change having a fluctuating width of not more than 0.12%. Furthermore, in the acceptable examples, there were shown good values on the compressibility (evaluated by green density under the shaping pressure of 5 t/cm$^2$) and the strength (evaluated by tensile strength).

On the contrary, in Comparative Examples 1 and 2, the quantity of oxidized Cr among Cr content was not more than 20%, so that the fluctuating width exceeded 0.15% and the properties are deteriorated. In Comparative Example 3, the quantities of Cr and Mn were 0.006%, which were below the lower limit of the adequate range, so that the fluctuating width of dimensional change in the sintered body to the fluctuation of the amount of graphite added exceeded 0.15%. In Comparative Example 4, the quantity of Cr+Mn exceeded 0.5 wt %, so that the compressibility was poor and the strength was low. Similarly, since the quantity of Cr+Mn exceeded 0.5 wt % in Comparative Example 5 and the oxygen concentration exceeded 0.3 wt % in Comparative Example 6, the compressibility was lowered and the strength was low.

EXAMPLE 5

Water-atomized green iron powder having a composition of 0.05–0.5 wt % of Cr, 0.01–0.3 wt % of Mn and the reminder being Fe and inevitable impurity was subjected to an oxidation treatment in a nitrogen atmosphere by varying an oxygen concentration and then reduced in a pure hydrogen atmosphere at 930° C. for 20 minutes, and thereafter a relation between oxygen concentration in the atmosphere and ratio of oxidized Cr was measured to obtain results as shown in Table 11.

TABLE 11

| | Composition of green powder (%) | | Oxygen concentration in nitrogen | Composition of finished iron powder (%) | | |
|---|---|---|---|---|---|---|
| No. | Mn | Cr | (vol %) | O | ratio of oxidized Cr | Remarks |
| 16 | 0.22 | 0.20 | 5 | 0.21 | 54 | Acceptable Example 10 |
| 17 | 0.20 | 0.15 | 14 | 0.25 | 65 | Acceptable Example 11 |
| 18 | 0.19 | 0.20 | 1 | 0.17 | 12 | Comparative Example 7 |
| 19 | 0.20 | 0.15 | 21 | 0.41 | 73 | Comparative Example 8 |

As seen from this table, in all acceptable examples in which the oxygen concentration in the nitrogen atmosphere satisfied the range defined in the invention, the oxygen content in the finished iron powder is not more than 0.3 wt % and the oxidation ratio of Cr per total Cr is not less than 20%. On the other hand, in Comparative Example 7 in which the oxygen concentration in the nitrogen atmosphere did not satisfy the lower limit according to the invention, the oxygen content in the finished iron powder was not more than 0.3 wt %, but the ratio of oxidized Cr was not more than 20%, while in Comparative Example 8 in which the oxygen concentration in the nitrogen atmosphere exceeded the upper limit according to the invention, the oxygen content in the finished iron powder exceeded 0.3 wt %.

EXAMPLE 6

Each of iron powders containing various contents of Si as shown in Table 12 is added and mixed with 1.5 wt % of Cu powder, 0.5 wt % of graphite powder and 1 wt % of zinc stearate as a lubricant, shaped into a ring-shaped green compact having an outer diameter of 60 mm, an inner diameter of 25 mm and a height of 10 mm and a green density of 6.9 g/cm$^3$, and then sintered in an RX gas having a $CO_2$ content of 0.3% at 1130° C. for 20 minutes.

The fluctuating width of dimensional change in the resulting sintered body was measured to obtain results as shown in Table 12 together with results measured on the oxidation ratio of elementary Si in the iron powder and the scattering width of the oxidation ratio.

The fluctuating width of dimensional change was evaluated by a scattering width of dimensional change in the sintering on 100 specimens based on the green compact having the same outer diameter.

As seen from this table, in all acceptable examples according to the invention containing an adequate amount of Si, not less than 20% of which being rendered into an oxide, good accuracy of dimensional change was obtained, while in the comparative examples, the fluctuating width of dimensional change in the sintered body was still large.

TABLE 12

| Symbol of iron powder | Si content (wt %) | Oxidation ratio of Si (%) | Scattering width of oxidation ratio in Si content (%) | Fluctuating width of dimensional change in sintered body (%) | Remarks |
|---|---|---|---|---|---|
| A | 0.004 | 15~85 | 70 | 0.56 | Comparative Example 1 |
| B | 0.007 | 17~80 | 63 | 0.52 | Comparative Example 2 |
| C | 0.008 | 25~40 | 15 | 0.04 | Acceptable Example 1 |
| D | 0.016 | 30~40 | 10 | 0.04 | Acceptable Example 2 |
| E | 0.025 | 35~45 | 10 | 0.02 | Acceptable Example 3 |
| F | 0.027 | 55~75 | 20 | 0.04 | Acceptable Example 4 |

EXAMPLE 7

According to the same manner as in Example 6, each of iron powders having various amounts of Si shown in Table 13 was added and mixed with 2.0 wt % of Cu powder, 0.8 wt % of graphite powder and 1 wt % of zinc stearate as a lubricant, shaped into a ring-shaped green compact having an outer diameter of 60 mm, an inner diameter of 25 mm and a height of 10 mm and a green density of 6.9 g/cm$^3$, whereby 100 specimens were produced. Then, these specimens were sintered in an AX gas at 1130° C. for 20 minutes, and the quantity of dimensional change in the sintering based on the green compact having the same outer diameter was measured to examine the fluctuating width thereof.

The results measured on the fluctuating width of dimensional change in the sintered body are also shown in Table 13 together with results measured on the oxidation ratio of elementary Si in the iron powder and the scattering width of the oxidation ratio.

As seen from this table, in all acceptable examples according to the invention containing an adequate amount of Si, not less than 20% of which being rendered into an oxide, good accuracy of dimensional change was obtained, while in the comparative examples, the fluctuating width of dimensional change in the sintered body was still large.

TABLE 13

| Symbol of iron powder | Si content (wt %) | Oxidation ratio of Si (%) | Scattering width of oxidation ratio in Si content (%) | Fluctuating width of dimensional change in sintered body (%) | Remarks |
|---|---|---|---|---|---|
| A | 0.004 | 15~85 | 70 | 0.50 | Comparative Example 3 |
| B | 0.007 | 17~80 | 63 | 0.46 | Comparative Example 4 |
| C | 0.008 | 25~40 | 15 | 0.02 | Acceptable Example 5 |
| D | 0.016 | 30~40 | 10 | 0.02 | Acceptable Example 6 |
| E | 0.025 | 35~45 | 10 | 0.02 | Acceptable Example 7 |
| F | 0.027 | 55~75 | 20 | 0.04 | Acceptable Example 8 |

EXAMPLE 8

Each of green powders obtained by water atomizing molten steels having various amounts of Si and Mn is subjected to an oxidation treatment in a nitrogen atmosphere having different oxygen concentrations at 140° C. for 60 minutes and then subjected to a reduction treatment in a pure hydrogen atmosphere at 930° C. for 20 minutes to produce iron powders (average particle size: 80 μm) having a chemical composition, quantity of oxide and scattering width of oxidation ratio shown in Table 14.

Then, the fluctuating width of dimensional change when the sintered body was produced by using these powders and the green density of the green compact were measured to obtain results as shown in Table 14.

The fluctuating width of dimensional change in the sintered body was evaluated as a scattering width determined from a quantity of dimensional change in the sintering based on the green compact having the same outer diameter with respect to 100 sintered specimens obtained by adding and mixing iron powder with 1.5 wt % of copper powder, 0.5 wt % of graphite powder and 1 wt % of zinc stearate as a lubricant, shaping into a ring-shaped green compact having a density of 6.9 g/cm$^3$, an outer diameter of 60 mm, an inner diameter of 25 mm and a height of 10 mm and sintering in a propane-modified gas having a $CO_2$ content of 0.3% at 1130° C. for 20 minutes.

And also, the green density was measured when the same iron powder as mentioned above was added and mixed with 1 wt % of zinc stearate and shaped under a shaping pressure of 5 t/cm$^2$.

Moreover, the scattering width of oxidized Si ratio in the Si content was determined from a scattering width obtained by dividing the iron powder into 10 parts and analyzing a ratio of $SiO_2$ quantity to total Si amount per each part.

TABLE 14

| | Composition of iron powder (%) | | | Scattering range of oxidation ratio in Si content | Scattering width of oxidation ratio in Si content | Oxygen concentration in atmosphere | Fluctuating width of dimensional change in sintered body | Green density | |
|---|---|---|---|---|---|---|---|---|---|
| No. | Si | Mn | O | (%) | (%) | (vol %) | (%) | (g/cm$^3$) | Remarks |
| 1 | 0.008 | 0.04 | 0.12 | 20~30 | 10 | 5 | 0.06 | 6.97 | Acceptable Example 1 |
| 2 | 0.010 | 0.24 | 0.13 | 30~40 | 10 | 5 | 0.06 | 6.98 | Acceptable Example 2 |
| 3 | 0.016 | 0.10 | 0.13 | 35~45 | 10 | 2.5 | 0.05 | 6.98 | Acceptable Example 3 |
| 4 | 0.016 | 0.10 | 0.25 | 40~60 | 20 | 5 | 0.04 | 6.97 | Acceptable Example 4 |
| 5 | 0.016 | 0.10 | 0.25 | 45~75 | 30 | 7.5 | 0.04 | 6.97 | Acceptable Example 5 |
| 6 | 0.020 | 0.30 | 0.14 | 45~50 | 5 | 5 | 0.04 | 6.97 | Acceptable Example 6 |
| 7 | 0.025 | 0.03 | 0.14 | 45~50 | 5 | 5 | 0.03 | 6.95 | Acceptable Example 7 |
| 8 | 0.004 | 0.003 | 0.12 | 5~100 | 95 | 5 | 0.60 | 7.00 | Comparative Example 1 |
| 9 | 0.30 | 0.35 | 0.30 | 45~55 | 10 | 5 | 0.11 | 6.77 | Comparative Example 2 |
| 10 | 0.07 | 0.10 | 0.29 | 0~20 | 20 | 1 | 0.55 | 6.96 | Comparative Example 3 |
| 11 | 0.016 | 0.10 | 0.12 | 1~54 | 54 | 1 | 0.70 | 6.98 | Comparative Example 4 |

As seen from this table, all of Acceptable Examples 1–7 contained adequate amounts of Si and Mn, in which not less than 20% of Si and Mn amounts was rendered into an oxide and the scattering width thereof was not more than 50%, so that there was obtained an excellent accuracy of dimensional change of not more than 0.06%, which was lower than the typical lower limit of the dimensional accuracy after the correction of dimensional change through the conventional sizing. Further, the compressibility is very good.

On the contrary, all of the comparative examples are the case that the chemical composition, ratio of Si+Mn amount as an oxide and further oxygen concentration in the atmosphere do not satisfy the adequate ranges defined in the invention, so that the satisfactory results were not obtained in the accuracy of dimensional change in the sintered body and the compressibility.

EXAMPLE 9

Each of green powders obtained by water atomizing molten steels having various amounts of Si and Mn was subjected to an oxidation treatment in a nitrogen atmosphere having different oxygen concentrations at 140° C. for 60 minutes and then subjected to a reduction treatment in a pure hydrogen atmosphere at 930° C. for 20 minutes to produce iron powders (average particle size: 70 μm) having a chemical composition, quantity of oxide and scattering width of oxidation ratio shown in Table 15.

Then, the fluctuating width of dimensional change when the sintered body was produced by using these powders and the radial crushing strength were measured to obtain results as shown in Table 15.

The state of Si oxide on the particle surface of iron powder was observed by Auger analysis.

The fluctuating width of dimensional change in the sintered body was determined from a quantity of dimensional change before and after the sintering when pure iron powder was added and mixed with 0.8 wt % of two kinds of graphites having average particle sizes of 34 μm and 6 μm, shaped into a ring-shaped green compact of Fe-2% Cu-0.8% graphite having an outer diameter of 60 mm, an inner diameter of 25 mm, a height of 10 mm and a green density of 6.80 g/cm$^3$ and sintered in a propane-modified gas having a $CO_2$ content of 0.3% at 1130° C. for 20 minutes.

Moreover, the radial crushing strength of the sintered body is measured with respect to a sintered body obtained by sintering a ring-shaped green compact having the same composition and green density as mentioned above and an outer diameter of 38 mm, an inner diameter of 25 mm and a height of 10 mm in a propane-modified gas having a $CO_2$ content of 0.3% at 1130° C. for 20 minutes.

TABLE 15

| No. | Oxygen concentration in atmosphere (vol %) | Composition of iron powder (%) Si | Mn | O | Oxidation ratio of Si and Mn (%) | Scattering width of oxidation ratio in Si, Mn content (%) | Presence of island-like Si oxide on surface of iron powder | Difference of dimensional change in sintered body (%) | Radial crushing strength ($N/mm^2$) | Remarks |
|---|---|---|---|---|---|---|---|---|---|---|
| 1 | 5 | 0.026 | 0.05 | 0.12 | 30~60 | 30 | presence | 0.06 | 735 | Acceptable Example 1 |
| 2 | 5 | 0.10 | 0.06 | 0.15 | 45~78 | 33 | presence | 0.06 | 730 | Acceptable Example 2 |
| 3 | 5 | 0.21 | 0.26 | 0.17 | 35~60 | 25 | presence | 0.05 | 730 | Acceptable Example 3 |
| 4 | 10 | 0.34 | 0.11 | 0.17 | 40~60 | 20 | presence | 0.03 | 720 | Acceptable Example 4 |
| 5 | 5 | 0.024 | 0.008 | 0.14 | 30~90 | 60 | none | 0.10 | 740 | acceptable Example 5 |
| 6 | 5 | 0.50 | 0.30 | 0.28 | 40~50 | 10 | presence | 0.03 | 600 | Comparative Example 1 |
| 7 | 5 | 0.21 | 0.35 | 0.18 | 40~95 | 55 | presence | 0.11 | 660 | Comparative Example 2 |
| 8 | 2.0 | 0.08 | 0.20 | 0.10 | 0~20 | 20 | none | 0.30 | 735 | Comparative Example 3 |
| 9 | 18 | 0.21 | 0.26 | 0.34 | 50~100 | 50 | presence | 0.12 | 650 | Comparative Example 4 |
| 10 | 5 | 0.62 | 0.08 | 0.40 | 50~70 | 20 | presence | 0.03 | 665 | Comparative Example 5 |

As seen from this table, when using the iron powder according to the invention (Acceptable Examples 1–5), the fluctuating width of dimensional change was not more than 0.1%. Particularly, when Si oxide was distributed on the particle surface of the iron powder in island form (Acceptable Examples 1–4), even if the average particle size of graphite powder added was largely different between 34 μm and 6 μm, the fluctuating width of dimensional change in the sintered body was as very low as not more than 0.06%, and also the radial crushing strength was as high as not less than 700 $N/mm^2$.

On the other hand, all of the comparative examples are the case that the chemical composition and the ratio of Si quantity as an oxide did not satisfy the adequate ranges defined in the invention, so that a good accuracy of dimensional change in the sintered body is not obtained as mentioned below.

In Comparative Examples 1 and 2, the Si+Mn amount is not less than 0.50% exceeding the defined upper limit, so that the radial crushing strength was lower than 700 $N/mm^2$.

In Comparative Example 3, the oxygen concentration in the atmosphere when water-atomized powder is dried was 2.0 vol % lower than the defined value, so that the fluctuation of dimensional change was large.

In Comparative Examples 4 and 5, the O content is 0.34 wt % and the Si content is 0.62 wt %, which exceeded the defined upper limits, respectively, so that only the radial crushing strength of lower than 700 $N/mm^2$ was obtained.

EXAMPLE 10

Water-atomized iron powder (average particle size: 70 μm) was added with not more than 0.3 wt % of various oxide powders shown in Table 16 (average particle size: 5 μm) and added and mixed with 1.5 wt % of electrolytic copper powder (average particle size: not more than 44 μm), 0.9 wt % of graphite powder (average particle size: not more than 10 μm) and 1 wt % of a solid lubricant, shaped at a green density of 7.0 $g/cm^3$ into a test specimen for transverse rupture strength having a length of 35 mm, a width of 10 mm and a height of 5 mm and then sintered in a propane-modified gas at 1130° C. for 20 minutes.

The fluctuating width of dimensional change in the longitudinal direction of the sintered body before and after the sintering and the transverse rupture strength was measured to obtain results as shown in Table 16.

TABLE 16(a)

| No. | Oxide added | Addition amount (wt %) | Green density ($g/cm^3$) | Dimensional change of sintered body based on green compact | Fluctuating width of dimensional change (%) | Transverse rupture strength ($kgf/mm^2$) | Remarks |
|---|---|---|---|---|---|---|---|
| 1 | — | 0 | 6.90 | 0.09 | 0.21 | 80 | Comparative Example 1 |
| 2 | $Al_2O_3$ | 0.01 | 6.89 | 0.15 | 0.07 | 80 | Example 1 |
| 3 | " | 0.05 | 6.89 | 0.20 | 0.06 | 79 | Example 2 |
| 4 | " | 0.10 | 6.88 | 0.25 | 0.05 | 79 | Example 3 |
| 5 | " | 0.20 | 6.87 | 0.25 | 0.04 | 75 | Example 4 |
| 6 | " | 0.30 | 6.85 | 0.26 | 0.04 | 73 | Comparative Example 2 |
| 7 | $TiO_2$ | 0.01 | 6.89 | 0.14 | 0.10 | 82 | Example 5 |
| 8 | " | 0.05 | 6.88 | 0.19 | 0.07 | 80 | Example 6 |
| 9 | " | 0.10 | 6.88 | 0.25 | 0.07 | 79 | Example 7 |
| 10 | " | 0.20 | 6.86 | 0.25 | 0.05 | 73 | Example 8 |
| 11 | " | 0.30 | 6.84 | 0.26 | 0.05 | 71 | Comparative Example 3 |
| 12 | $SiO_2$ | 0.01 | 6.89 | 0.15 | 0.09 | 80 | Example 9 |
| 13 | " | 0.05 | 6.89 | 0.19 | 0.07 | 79 | Example 10 |
| 14 | " | 0.10 | 6.88 | 0.25 | 0.06 | 78 | Example 11 |
| 15 | " | 0.20 | 6.86 | 0.25 | 0.03 | 76 | Example 12 |
| 16 | " | 0.30 | 6.84 | 0.25 | 0.03 | 72 | Comparative Example 4 |
| 17 | $V_2O_3$ | 0.01 | 6.90 | 0.15 | 0.11 | 81 | Example 13 |
| 18 | " | 0.05 | 6.89 | 0.20 | 0.07 | 81 | Example 14 |
| 19 | " | 0.10 | 6.88 | 0.26 | 0.07 | 79 | Example 15 |
| 20 | " | 0.20 | 6.87 | 0.26 | 0.05 | 77 | Example 16 |
| 21 | " | 0.30 | 6.85 | 0.26 | 0.05 | 74 | Comparative Example 5 |

TABLE 16(b)

| No. | Oxide added | Addition amount (wt %) | Green density (g/cm$^3$) | Dimensional change of sintered body based on green compact | Fluctuating width of dimensional change (%) | Transverse rupture strength (kgf/mm$^2$) | Remarks |
|---|---|---|---|---|---|---|---|
| 22 | MnO | 0.01 | 6.89 | 0.14 | 0.11 | 82 | Example 17 |
| 23 | " | 0.05 | 6.88 | 0.20 | 0.08 | 81 | Example 18 |
| 24 | " | 0.10 | 6.88 | 0.26 | 0.06 | 81 | Example 19 |
| 25 | " | 0.20 | 6.87 | 0.26 | 0.06 | 72 | Example 20 |
| 26 | " | 0.30 | 6.85 | 0.26 | 0.05 | 75 | Comparative Example 6 |
| 27 | $Cr_2O_3$ | 0.01 | 6.89 | 0.14 | 0.09 | 82 | Example 21 |
| 28 | " | 0.05 | 6.89 | 0.21 | 0.07 | 82 | Example 22 |
| 29 | " | 0.10 | 6.89 | 0.25 | 0.06 | 80 | Example 23 |
| 30 | " | 0.20 | 6.87 | 0.25 | 0.06 | 78 | Example 24 |
| 31 | " | 0.30 | 6.85 | 0.25 | 0.04 | 74 | Comparative Example 7 |
| 32 | NiO | 0.01 | 6.89 | 0.02 | 0.21 | 80 | Comparative Example 8 |
| 33 | " | 0.05 | 6.89 | 0.00 | 0.20 | 84 | Comparative Example 9 |
| 34 | " | 0.10 | 6.88 | −0.03 | 0.20 | 80 | Comparative Example 10 |
| 35 | " | 0.20 | 6.88 | −0.09 | 0.21 | 79 | Comparative Example 11 |
| 36 | $Cu_2O$ | 0.01 | 6.89 | 0.12 | 0.20 | 73 | comparative Example 12 |
| 37 | " | 0.05 | 6.88 | 0.14 | 0.20 | 82 | Comparative Example 13 |
| 38 | " | 0.10 | 6.88 | 0.18 | 0.21 | 83 | Comparative Example 14 |
| 39 | " | 0.20 | 6.87 | 0.25 | 0.20 | 79 | Comparative Example 15 |

As seen from this table, in all acceptable examples adding adequate amounts of oxides, the quantity of dimensional change in the sintered body was constant and the scattering thereof was very small. Further, the transverse rupture strength was substantially constant up to 0.1 wt %.

On the other hand, when using $Cu_2O$ powder or NiO powder (average particle size: 5 μm) in which a value of standard free energy of formation of oxide at 1000° C. was smaller than −120 kcal/1 mol of $O_2$, the dimension tends to expand with the increase of the amount of $Cu_2O$ added, or NiO tended to contract the dimension. In any case, the fluctuating width of dimensional change made little difference to the case of changing the dimension.

Furthermore, when the addition amount is less than 0.01 wt %, the quantity of adjusting dimensional change is small, while when it exceeded 0.20 wt %, the green density and the transverse rupture strength of the sintered body was rapidly lowered.

INDUSTRIAL APPLICABILITY

The iron powder for powder metallurgy and mixed powder thereof according to the invention considerably reduce the fluctuating width of dimensional change in the sintered body irrespectively of the amount of graphite added and particle size in the sintering after the addition of Cu and graphite as compared with the conventional iron powder for powder metallurgy, whereby there can be obtained the accuracy of dimensional change equal to or more than that after the conventional sizing step and also the radial crushing strength of the sintered body is stably obtained. Therefore, the design and production of sintered parts having a high strength can easily be attained without conducting the sizing.

Particularly, the oxidation ratio can strictly be controlled in the mixed powder, whereby the dimensional fluctuating width can be controlled with a higher accuracy. Moreover, the quantity of dimensional change of the sintered parts can freely be adjusted by adjusting the quantity of the oxide added.

We claim:

1. Iron powder for powder metallurgy consisting of 0.008–0.5 wt % in total of at least one element having a value of standard free energy of formation of oxide at 1000° C. of not more than −120 kcal/1 mol of $O_2$, not more than 0.30 wt % of oxygen and the reminder being Fe and inevitable impurity, in which not less than 20% of the above element is an oxide.

2. Iron powder for powder metallurgy consisting of 0.008–0.5 wt % in total of at least one element having a value of standard free energy of formation of oxide at 1000° C. of not more than −120 kcal/1 mol of $O_2$, not more than 0.30 wt % of oxygen and the reminder being Fe and inevitable impurity, in which not less than 20% of the above element is an oxide and a scattering width of oxidation ratio is not more than 50%.

3. Iron powder for powder metallurgy according to claim 1 or 2, wherein the element having a value of standard free energy of formation of oxide at 1000° C. of not more than −120 kcal/1 mol of $O_2$ is selected from Cr; Mn, V, Si, Ti and Al.

4. A method of producing iron powder for powder metallurgy, wherein iron powder having a composition consisting of 0.008–0.5 wt % in total of at least one element having a value of standard free energy of formation of oxide at 1000° C. of not more than −120 kcal/1 mol of $O_2$ and the reminder being Fe and inevitable impurity is subjected to an oxidation treatment at a temperature of 100°–200° C. in a nitrogen atmosphere having an oxygen concentration of 2.5–15.0 vol % and then subjected to a selective reduction treatment for oxidized Fe in a reducing atmosphere at 800°–1000° C.

5. A method of producing iron powder for powder metallurgy according to claim 4, wherein the oxidation treatment of iron powder is conducted with stirring.

* * * * *

UNITED STATES PATENT AND TRADEMARK OFFICE

CERTIFICATE OF CORRECTION

PATENT NO. : 5,458,670

DATED : October 17, 1995

INVENTOR(S) : Kuniaki Ogura et al

It is certified that error appears in the above-indentified patent and that said Letters Patent is hereby corrected as shown below:

Columns 17-18:
In Table 10, under the column "Tensile strength (kgf/mm$^2$)" delete the ninth entry "42" and substitute --41--.

In Column 23, Line 35, delete "is" and substitute --was--;
Line 37, delete "is" and substitue --was--.

In Column 26, Line 46, after "Cr" delete the semi-colon and substitute a comma.

Signed and Sealed this

Nineteenth Day of March, 1996

*Attest:*

Bruce Lehman

BRUCE LEHMAN

*Attesting Officer*

*Commissioner of Patents and Trademarks*